US006102159A

United States Patent [19]

Rogate

[11] Patent Number: 6,102,159

[45] Date of Patent: Aug. 15, 2000

[54] PORTABLE SYSTEM FOR REMOVING OIL FROM AN OIL CONTAINING DEVICE

[76] Inventor: Steven Rogate, 84 Jenkins Ave., North Babylon, N.Y. 11703

[21] Appl. No.: 09/157,260

[22] Filed: Sep. 21, 1998

[51] Int. Cl.[7] ..... F16C 3/14

[52] U.S. Cl. ..... 184/1.5; 184/6.28; 184/26; 123/196 R; 141/98

[58] Field of Search ..... 184/1.5, 6.28, 184/26, 6.5, 6.12; 123/196 R; 141/98

[56] References Cited

U.S. PATENT DOCUMENTS

| | | | |
|---|---|---|---|
| 4,240,523 | 12/1980 | Nestor et al. | 184/1.5 |
| 4,354,574 | 10/1982 | Kieber | 184/1.5 |
| 4,976,233 | 12/1990 | Bedi et al. | 123/196 R |
| 5,056,621 | 10/1991 | Trevino | 184/1.5 |
| 5,074,379 | 12/1991 | Batrice | 184/1.5 |
| 5,203,429 | 4/1993 | Zager | 184/1.5 |
| 5,332,064 | 7/1994 | Liu | 184/6.4 |
| 5,375,703 | 12/1994 | Deuber | 141/98 |
| 5,435,413 | 7/1995 | Schoenborn | 184/1.5 |
| 5,667,195 | 9/1997 | McCormick | 251/149.6 |

*Primary Examiner*—David M. Fenstermacher
*Attorney, Agent, or Firm*—Richard L. Miller, P.E.

[57] ABSTRACT

A portable system for removing oil from an oil containing device. The system includes a pump, fluid conduit apparatus, and power conduit apparatus. The pump pumps the oil out of the oil containing device. The fluid conduit apparatus is in fluid communication with the pump and with the oil containing device. The power conduit apparatus is in electrical communication with the pump. The pump is in fluid communication with a receptacle for the oil, with circumferential threads around the pump threadably engaging a pre-existing threaded hole in the lid of the receptacle. The pump further has a lower vent hole in fluid communication with the receptacle and an upper vent hole in fluid communication with the lower vent hole and the ambient, which allows the pump to be self-venting. The fluid conduit apparatus comprises a tube that is in fluid communication with the pump and interfacing apparatus disposed on the tube and in fluid communication with the oil in the oil containing device. The interfacing apparatus comprises either an elongated rigid tube positioned through an oil filler hole in the oil containing device or a spigot threadably engaging into a drain hole in the oil containing device and remaining thereat, while replaceably engaging the tube. The power conduit apparatus comprises a cable that is in electrical communication with the pump and a cigarette lighter adapter that engages a cigarette lighter.

2 Claims, 1 Drawing Sheet

PORTABLE SYSTEM FOR REMOVING OIL FROM AN OIL CONTAINING DEVICE

BACKGROUND OF THE INVENTION

1. Field of the Invention

The present invention relates to a system for removing oil from an oil containing device. More particularly, the present invention relates to a portable system for removing oil from an oil containing device.

2. Description of the Prior Art

Numerous innovations for oil changing devices have been provided in the prior art that will be described. Even though these innovations may be suitable for the specific individual purposes to which they address, however, they differ from the present invention.

A FIRST EXAMPLE, U.S. Pat. No. 4,240,523 to Nestor et al. teaches a reversible fluid pump driven by a reversible electric motor under the control of a three position toggle switch wired for off, forward and reverse. One port of the pump is connected to a four position valve, one position of which is off. A hose to a drain receptacle or to an oil supply connects to the other port of the pump and hoses from engine crankcases connect to the three active ports of the valve. A two position valve adapts the pump for single engine use. The handle for selectively positioning each of the valves extends perpendicularly to the valve stem and when in off position aligns with the toggle. Safety latches of alternate constructions, with or without thumb screw tightening means, are each pivoted to the handle to engage the toggle and retain both the valve and toggle in off position when the system is not in use.

A SECOND EXAMPLE, U.S. Pat. No. 4,976,233 to Bedi et al. teaches quick connect coupling adapters for facilitating simplified rapid oil change in an associated internal combustion engine, including a drain opening adapter having an integral body with a central throughbore and a branch throughbore angularly oriented thereto. The adapter includes appropriate means for attaching an end of the branch throughbore to the drain plug opening and means for sealingly attaching the drain plug to one end of the central throughbore. An oil conveying hose is attached to the other end of the central throughbore. The oil conveying hose includes a quick connect coupling releasably attachable to an external pump device. An additional oil fill adapter is positionable in a suitable engine opening such as the dipstick tube or oil fill opening in the valve cover. The oil fill adapter includes a central oil conveying body having an inlet and an outlet means for attaching the outlet in the engine and a fill hose attached to the inlet. The fill hose includes a suitable quick connect coupling member releasably attachable to a fill point on an external pump device.

A THIRD EXAMPLE, U.S. Pat. No. 5,074,379 to Batrice teaches an oil change apparatus for use in changing the motor oil in a motor vehicle that includes a key-operated drain valve removable mounted within a lockable protective housing and a flexible line connecting the drain valve with the engine oil pan of the motor vehicle. An oil filter relocation flange and bracket accessibly mounted within the engine compartment and coupled via oil lines to the original engine block receptacle for the oil filter serves to relocated the engine oil filter to a position that provides easy access. A power assisted oil change apparatus includes an electrical pump and electro-mechanical valve conveniently mounted within the engine compartment of the motor vehicle for pumping used motor oil from the engine oil pan into a disposable container at oil change times.

A FOURTH EXAMPLE, U.S. Pat. No. 5,203,429 to Zager teaches a system for draining and filling oil reservoirs in the crankcases and the transmissions of vehicles with two or more engines, including a motor driver pump, conduits connecting the pump to the crankcases and transmissions of each engine, the generator, and an oil sump; and selector valves to connect the conduits to the pump in a variety of combinations.

A FIFTH EXAMPLE, U.S. Pat. No. 5,667,195 to McCormick teaches a fluid drain apparatus that includes a quick drain assembly which may be permanently installed on a fluid tank or receptacle, and a cooperating quickly attachable and releasable connector assembly which mates with the drain assembly. The drain and connector provide for automatic opening of a drain valve within the drain portion of the apparatus, when the connector is removably connected to the drain portion. The connector is automatically retained on the drain portion until release by a mechanic or other person, without requiring continual retaining on the drain portion by the mechanic during the draining operation. A drain hose and portable collection tank may be provided with the drain valve and connector, along with a storage hook for the hose and caps for the tank which preclude leakage from the hose or tank. A suction pump may also be provided to accelerate the fluid flow from the fluid tank being drained. The apparatus is adaptable to virtually any fluid tank or receptacle, but is particularly adapted to use with internal combustion engine oil tanks and the like.

It is apparent that numerous innovations for oil changing devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a portable system for removing oil from an oil containing device that avoids the disadvantages of the prior art.

ANOTHER OBJECT of the present invention is to provide a portable system for removing oil from an oil containing device that is simple and inexpensive to manufacture.

STILL ANOTHER OBJECT of the present invention is to provide a portable system for removing oil from an oil containing device that is simple to use.

BRIEFLY STATED, YET ANOTHER OBJECT of the present invention is to provide a portable system for removing oil from, an oil containing device. The system includes a pump, fluid conduit apparatus, and power conduit apparatus. The pump pumps the oil out of the oil containing device. The fluid conduit apparatus is in fluid communication with the pump and with the oil containing device. The power conduit apparatus is in electrical communication with the pump. The pump is in fluid communication with a receptacle for the oil, with circumferential threads around the pump threadably engaging a pre-existing threaded hole in the lid of the receptacle. The pump further has a lower vent hole in fluid communication with the receptacle and an upper vent hole in fluid communication with the lower vent hole and the ambient, which allows the pump to be self-venting. The fluid conduit apparatus comprises a tube that is in fluid communication with the pump and interfacing apparatus disposed on the tube and in fluid communication with the oil in the oil containing device. The interfacing apparatus comprises either an elongated rigid tube positioned through an oil filler hole in the oil containing device or a spigot threadably engaging into a drain hole in the oil containing device and remaining thereat, while replaceably engaging the tube. The power conduit apparatus comprises a cable that is in electrical communication with the pump and a cigarette lighter adapter that engages a cigarette lighter.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

DETAILED DESCRIPTION OF THE PREFERRED EMBODIMENT

Figure 1:
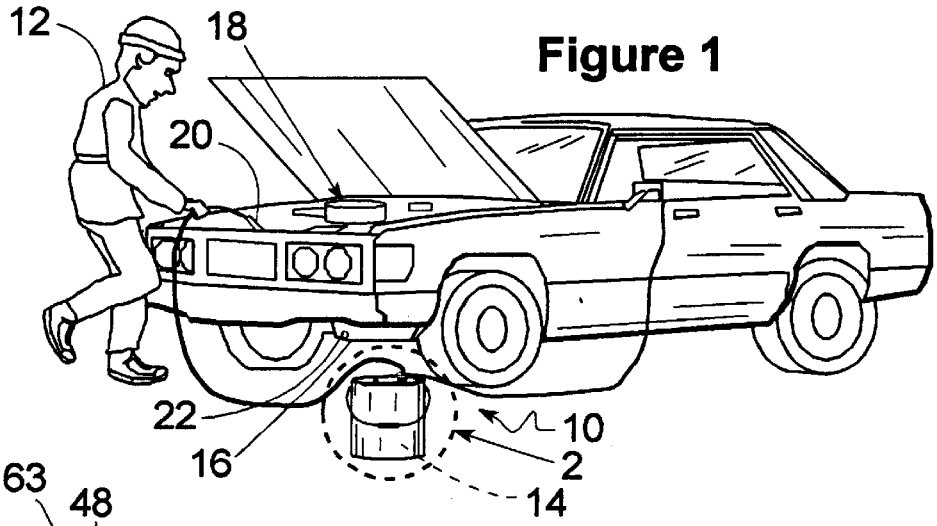
FIG. 1 is a diagrammatic perspective view of the present invention in use by a user removing oil from the crankcase of an internal combustion engine through its oil filler tube.

Referring now to the figures, in which like numerals indicate like parts, and particularly to FIG. 1, the portable system for removing oil from an oil containing device of the present invention is shown generally at 10 in use by a user 12 removing oil 14 from the crankcase 16 of an internal combustion engine 18 through one of the oil filler tube 20 of the internal combustion engine 18 and the drain plug hole 22 of the internal combustion engine 18.

Figure 2:
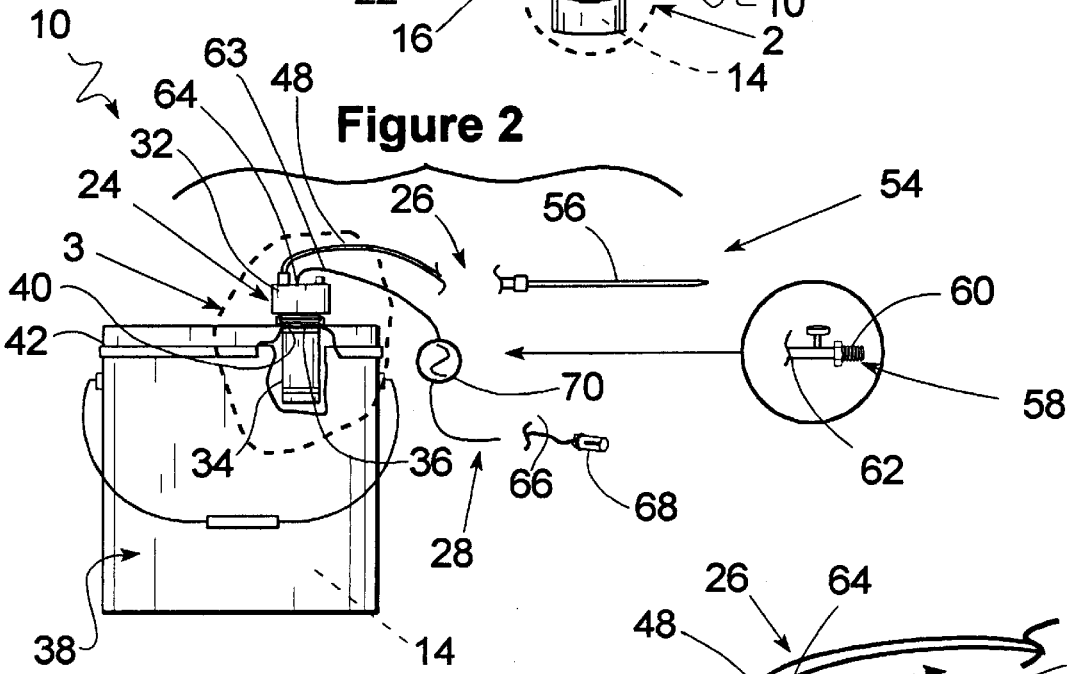
FIG. 2 is an enlarged diagrammatic front elevational view of the area generally enclosed by the dotted circle identified by arrow II in FIG. 1 of the present invention threadably installed on a pre-existing container.
Figure 3:
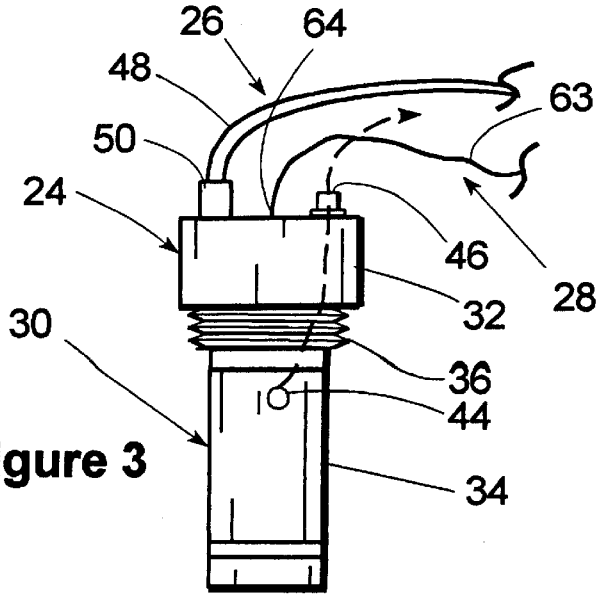
FIG. 3 is an enlarged diagrammatic front elevational view of the area generally enclosed by the dotted ellipse identified by arrow III in FIG. 2 of the vented pump of the present invention.

The configuration of the portable system for removing oil from an oil containing device 10 can best be seen in FIGS. 2 and 3, and as such will be discussed with reference thereto.

The portable system for removing oil from an oil containing device 10 comprises a pump 24 for pumping the oil 14 out of the crankcase 16 of the internal combustion engine 18.

The portable system for removing oil from an oil containing device 10 further comprises fluid conduit apparatus 26 in fluid communication with the pump 24 and for being in fluid communication with the crankcase 16 of the internal combustion engine 18.

The portable system for removing oil from an oil containing device 10 further comprises power conduit apparatus 28 in electrical communication with, and for powering, the pump 24.

The pump 24 has a body 30 that is generally cylindrically-shaped and vertically-oriented.

The body 30 of the pump 24 has an upper portion 32, a lower portion 34 that is hollow, and coaxial and in fluid communication with, the upper portion 32 of the body 30 of the pump 24, and external circumferential threads 36 separating the upper portion 32 of the body 30 of the pump 24 from the lower portion 34 of the body 30 of the pump 24.

The lower portion 34 of the body 30 of the pump 24 is for depending into, and being in fluid communication with, a receptacle 38 for the oil 14, with the circumferential threads 36 around the body 30 of the pump 24 for threadably engaging a pre-existing threaded hole 40 in a lid 42 of the receptacle 38.

The body 30 of the pump 24 further has a lower vent hole 44 that extends laterally in the lower portion 34 of the body 30 of the pump 24, just below the circumferential threads 36 around the body 30 of the pump 24, and is for fluidly communicating with the receptacle 38.

The body 30 of the pump 24 further has an upper vent hole 46 that extends axially in the upper portion 32 of the body 30 of the pump 24 and is in fluid communication with the lower vent hole 44 in the lower portion 34 of the body 30 of the pump 24, and is for fluidly communicating with the ambient, which allows the pump 24 to be self-venting.

The fluid conduit apparatus 26 comprises a tube 48 that extends, at one end 50, from, and is in fluid communication with, the upper portion 32 of the body 30 of the pump 24, to its other end 52, and which is in fluid communication with the lower portion 34 of the body 30 of the pump 24.

The fluid conduit apparatus 26 further comprises interfacing apparatus 54 that is disposed on the other end 52 of the tube 48 of the fluid conduit apparatus 26, and is for fluidly communicating with the oil 14 in the crankcase 16 of the internal combustion engine 18.

The interfacing apparatus 54 of the fluid conduit apparatus 26 can comprise an elongated rigid tube 56 for positioning through the oil filler tube 20 of the internal combustion engine 18, into the crankcase 16 of the internal combustion engine 18.

The interfacing apparatus 54 of the fluid conduit apparatus 26 can comprise a spigot 58 for threadably engaging, at one end 60, into the drain plug hole 22 of the internal combustion engine 18 and remaining thereat, and at its other end 62 replaceably engaging the other end 52 of the tube 48 of the fluid conduit apparatus 26.

The power conduit apparatus 28 comprises a cable 63 that extends, at one end 64, from, and is in electrical communication with, the upper portion 32 of the body 30 of the pump 24, to, at its other end 66, a cigarette lighter adapter 68 for engaging a cigarette lighter for powering the pump 24.

The power conduit apparatus 28 further comprises a switch 70 that is in electrical communication with the cable 63 of the power conduit apparatus 28, and selectively powers the pump 24.

It will be understood that each of the elements described above, or two or more together, may also find a useful application in other types of constructions differing from the types described above.

While the invention has been illustrated and described as embodied in a portable system for removing oil from an oil containing device, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable system for removing oil from an oil containing device, said system comprising:

a) a pump for pumping the oil out of the oil containing device; said pump having a body being generally cylindrically-shaped and upright; said body of said pump having:

i) an upper portion;

ii) a lower portion being hollow, and coaxial with, and in fluid communication with, said upper portion of said body of said pump;

iii) external circumferential threads separating said upper portion of said body of said pump from said lower portion of said body of said pump; said lower portion of said body of said pump being for depending into, and being in fluid communication with, a receptacle for the oil, with said circumferential threads around said body of said pump for threadably engaging a threaded hole in a lid of the receptacle;

iv) a lower vent hole extending laterally in said lower portion of said body of said pump, just below said circumferential threads around said body of said pump, and being for fluidly communicating with the receptacle; and v) an upper vent hole extending axially in said upper portion of said body of said pump, and being in fluid communication with said lower vent hole in said lower portion of said body of said pump, and being for fluidly communicating with ambient, which allows said pump to be self-venting;

b) fluid conduit apparatus in fluid communication with said pump and for being in fluid communication with the oil containing device; said fluid conduit apparatus comprising:

i) a tube extending at one end from and being in fluid communication with said upper portion of said body of said pump to the other end of said tube which is in fluid communication with said lower portion of said body of said pump; and ii) interfacing apparatus being disposed on said other end of said tube of said fluid conduit apparatus, and being for fluidly communicating with the oil in the oil containing device; said interfacing apparatus of said fluid conduit apparatus comprising a spigot for threadably engaging at one end into a drain hole in the oil containing device and remaining thereat and at its other end replaceably engaging said other end of said tube of said fluid conduit apparatus; and c) power conduit apparatus in electrical communication with, and for powering, said pump; said power conduit apparatus comprising:

i) a cable extending at one end from and being in electrical communication with said upper portion of said body of said pump to at its other end a cigarette lighter adapter for engaging a cigarette lighter for powering said pump; and ii) a switch being in electrical communication with said cable of said power conduit apparatus, and selectively powering said pump.

2. The portable system as defined in claim 1, wherein said interfacing apparatus of said fluid conduit apparatus comprises an elongated rigid tube for positioning through an oil filler hole in the oil containing device.

* * * * *